United States Patent [19]

Kjaer et al.

[11] Patent Number: 4,580,580

[45] Date of Patent: Apr. 8, 1986

[54] METHOD OF CUTTING OUT WRAPPERS OR BINDERS IN TWO STEPS FROM TOBACCO LEAVES, AND AN APPARATUS FOR CARRYING OUT THE METHOD

[75] Inventors: Ian Kjaer, Hadsund; Hans J. Moller, Harlev, both of Denmark

[73] Assignee: A/S Skandinavisk Tobakskompagni, Soborg, Denmark

[21] Appl. No.: 258,446

[22] Filed: Apr. 28, 1981

[30] Foreign Application Priority Data

May 12, 1980 [DK] Denmark ..... 2072/80

[51] Int. Cl.[4] ..... A24C 1/00; A24C 1/26; B26D 5/06

[52] U.S. Cl. ..... 131/105; 83/73; 83/74; 83/75; 83/925 R; 131/33; 131/36

[58] Field of Search ..... 131/280, 105, 33, 36; 83/69–75, 451, 925 R, 367, 368

[56] References Cited

U.S. PATENT DOCUMENTS

| | | | |
|---|---|---|---|
| 3,409,024 | 11/1968 | Menguy | 131/315 |
| 3,542,036 | 11/1970 | Hooper et al. | 131/33 |
| 4,094,325 | 6/1978 | Stoffers et al. | 131/280 |
| 4,203,453 | 5/1980 | Leclerc et al. | 131/280 |
| 4,226,148 | 10/1980 | Logan et al. | 131/280 |

FOREIGN PATENT DOCUMENTS

| | | |
|---|---|---|
| 879588 | 2/1980 | Belgium . |
| 2416087 | 8/1979 | France . |
| 2436569 | 4/1980 | France . |
| 7613724 | 6/1978 | Netherlands . |
| 7902987 | 10/1980 | Netherlands . |

*Primary Examiner*—V. Millin

*Attorney, Agent, or Firm*—Stevens, Davis, Miller & Mosher

[57] ABSTRACT

In the production of wrappers or binders of different sizes from tobacco leaves, these leaves are at first divided into strip pieces that are transferred to a conveyor section and by means of a scanner are scanned to ascertain usable areas with preference from the largest to the smallest size. The strip pieces cut out of the same halves of tobacco leaves (right and left sides) are advanced on a further conveyor section consisting of separate, parallel belts, from which strip pieces of equally large, usable areas are collected in the same bobbin, in which they are oriented parallel to the axis of the bobbin and with their usable areas aligned in the longitudinal direction of the bobbin web. The cutting of nondefective final wrappers or binders is subsequently carried out in a separate operation and without further sorting. This provides for obtaining an optimum output from the tobacco leaves by using an apparatus of non-complicated design.

5 Claims, 5 Drawing Figures

METHOD OF CUTTING OUT WRAPPERS OR BINDERS IN TWO STEPS FROM TOBACCO LEAVES, AND AN APPARATUS FOR CARRYING OUT THE METHOD

BACKGROUND OF THE INVENTION

Wrappers for tobacco articles are often cut out in the manner that an operator stretches a whole or a half tobacco leaf across a cutting table with a slightly protruding knife, following which the cutting is performed by a roller associated with the knife. When placing the tobacco leaf on the table the operator can attempt, firstly, that only undamaged or almost undamaged parts will lie within the cutting knife and so form part of the cut wrapper and, secondly, that it is made possible, according to the size of the leaf, to cut out at least one further wrapper from the same half of the tobacco leaf (right or left side). This provides for obtaining an optimum output, i.e. the greatest possible number of usable wrappers from a certain number of tobacco leaves, but it is a condition that the operator is sufficiently experienced and pays considerable attention while working, thus involving a relatively high wage cost per wrapper.

A still better output would be obtained if it were possible to cut out wrappers of different sizes, or different formats,from the same half of a tobacco leaf, but by the explained prior art method this possibility must be considered as excluded due to the cost problem.

The endeavours with a view to mechanizing the production of cigars and similar tobacco articles have also tended to increase the output and to reduce the expenses in connection with the cutting of wrappers, and a proposal in this respect is to perform the cutting in two steps, the tobacco leaves being at first cut into strips at appropriate width and parallel to the mid rib of the tobacco leaves, upon which said strips are trimmed at their ends and glued together longitudinally, somewhat overlapping each other, to form a continuous band that is rolled into a bobbin. Out of the tobacco band thus formed the desired size or sizes may be cut later on, appropriately immediately before they shall be used in a wrapper applying machine.

Prior to the strip cutting operation the tobacco leaves pass a photoelectric scanner controlling the trimming of the ends of the strips so as to minimize the waste caused by the trimming, and the scanner can further control the cutting-away of defective parts in the strips so that the wrappers cut out of the composite tobacco band can be expected to be faultless and without defects.

According to this technique the waste of tobacco as well as the need of manual work can be considerably reduced, but this requires a complicated apparatus for carryihg out the method and, moreover, each of the wrappers cut out of the tobacco band will frequently contain parts of two or more strips and will thus appear in varying colours, which is generally considered to be disadvantageous to the look of the finished tobacco article. This has occasioned a further development of the principle by which individual trimmed strip pieces of a sufficient length to produce the desired format are collected in separate bobbins by being transferred to a band-like web on which they are closely spaced in the longitudinal direction of the band and subsequently gripped between the windings of the bobbin formed by the web. The said strip pieces may consequently be used for tobacco articles that shall be free from colour variations in the wrapper, whereas only the shorter pieces are glued together into tobacco bands as explained above, but in return this modification of the method requires a further complication of the apparatus which will thus be extremely expensive to produce and also vulnerable to malfunction.

PURPOSE AND SUMMARY OF THE INVENTION

A purpose of the invention is to provide a method which in an essentially simpler way also results in an optimum output from the tobacco leaves, and by which colour variations in the prepared wrappers are fully avoided.

Starting from the explained prior art, the invention relates to a dual step method of cutting out wrappers or binders in two or more sizes from tobacco leaves which are cut into stripshaped pieces that are collected in bobbins and from which the final blanks ready for use are cut in a later operation. The method is characterised in that each piece of strip by means of a scanner is scanned to ascertain an area usable for a final blank with successive preference from the largest to the smallest of the actual sizes, and that the strip pieces cut out of either half of the tobacco leaf (right and left sides) are distributed, according to the size of their usable area, among a number of bobbins corresponding to the number of sizes, said bobbins comprising a web on which the strip pieces are oriented parallel to the axis of the bobbin and with the usable areas in alignment with each other longitudinally of the web.

The invention is based on the fact, obvious in itself, that a cut strip piece which according to its size should result in a wrapper of a primarily desired size A, but which owing to holes or scratches or defects in its edge cannot afford a usable area of said size may, nevertheless, contain material for a perfect wrapper of a smaller size B or C etc. or perhaps for two such wrappers. The method according to the invention profits from this fact in the way that the scanner is arranged to ascertain the wrapper size A, B or C and so on, for which a given piece of strip is most suitable, whereafter it is ensured that strip pieces for the different sizes are collected in respective bobbins. Each individual bobbin thus stores blanks or usable areas for wrappers of one and the same size A or B or C and so on, and said usable areas are further localized so on the bobbin web that by the unwinding thereof they successively occupy the same take-off position, from where they may be transferred in a predetermined movement to a correct position in the tool that is responsible for cutting out the usable wrapper.

If the pieces of strip, as known, are cut parallel to the longitudinal direction of the tobacco leaf, for instance in two or more widths in dependence on the width of the tobacco leaf, the innermost pieces that are cut closest to the mid rib, are often unnecessarily long, whereas the outermost pieces are too short, even as far as the smallest wrapper size is concerned. For this reason it is preferred, according to the invention, that the strip pieces in either half of the tobacco leaf are cut out in a longitudinal direction forming an angle with the axial direction of the tobacco leaf, and that the strip pieces are parallelized to said axial direction prior to the passage past the scanner. In this way it may be possible to avoid undersized outer strip pieces.

The invention further relates to an apparatus for carrying out the above explained method and comprising, as is known, a strip cutting device, a bobbin winding device including a plurality of bobbin units, a conveyor extending between said devices and comprising two or more parallel and independently and intermittently movable belts to pick up and to retain by suction a respective one of a plurality of strip pieces cut out side-by-side from the same half of a tobacco leaf, and a scanner disposed above the conveyor to ascertain usable areas in the strip pieces. The apparatus according to the invention differs from prior designs of the same type in that the bobbin units associated with the conveyor bands are positioned one behind the other along the conveyor belts with their bobbin axes parallel thereto, each unit comprising a mechanism activated in dependence on the scanning picture and operative to take off only those strip pieces that are predestined for the bobbin concerned.

A particular advantage of this arrangement is that strip pieces having equally large usable areas can always be collected in one and the same bobbin from the different belts, so that only one bobbin unit is needed for each size instead of one unit per size per belt.

This may appropriately be realized in the way that the take-off mechanism of each bobbin unit comprises a suction box mounted above and opening towards the conveyor belts, the bottom of said suction box being covered by the bobbin web during its movement towards the bobbin, and that the conveyor belts when otherwise stationary are movable towards and away from the bobbin web on the suction box. When the conveyor belts approach the bobbin web, the strip pieces will be transferred to the web by suction, and as long as this suction effect is maintained the pieces are held to the web during its movement towards the bobbin, in which the strip pieces are gripped between the turns of the web. Ordinary pivoting arms provided with suction mouth pieces might be used as well for the transfer, but this would considerably complicate the structure of the apparatus.

To ensure not only the correct distribution of the strip pieces among the bobbin units but also the correct positioning of the usable areas of the strips on the bobbin web, as mentioned above, the length of each advance movement of the belt may, according to the invention, be controlled in dependence on the scanning picture so that the strip pieces predestined for the same bobbin unit are placed with their usable areas in a predetermined take-off position vis-a-vis the bobbin unit. In this case the length of each step may be said to be roughly as well as finely adjustable, inasmuch as the rough adjustment for each belt ensures that a piece of strip is fed in one step to the bobbin unit for which this particular piece is predestined, and subsequently the fine adjustment ensures that the usable area of the strip piece is placed correctly in relation to the web of said bobbin unit. The two adjustments should, however, in practice be integrated with each other, and these adjustments as well as the movement between the suction boxes and the belts, and the feeding movement of the bobbin web, may be controlled from the scanner by means of a rather simple computer constructed according to known principles.

DETAILED DESCRIPTION OF THE PREFERRED EMBODIMENTS

Figure 1:
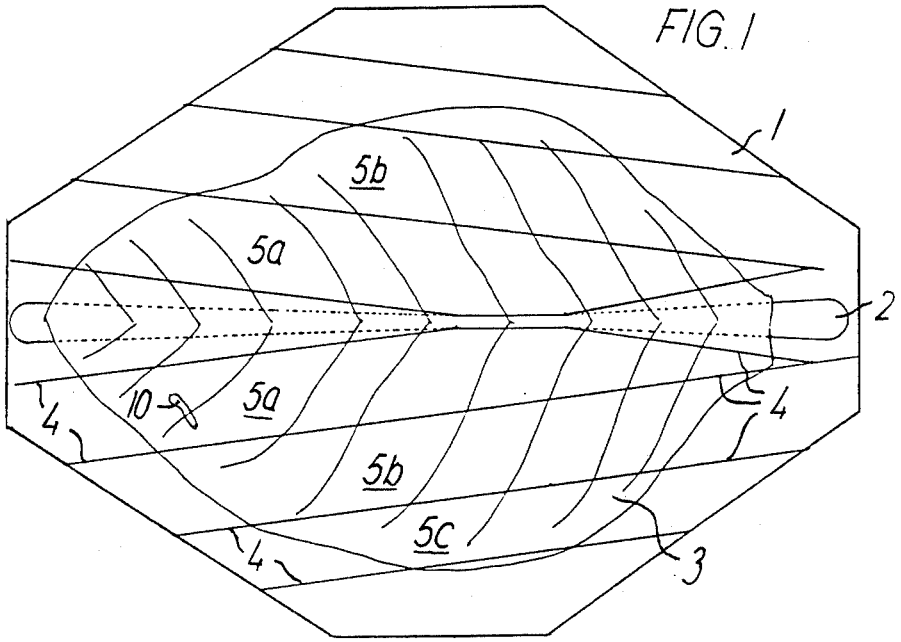
FIG. 1 is a schematically plan view of the strip cutting device of the apparatus with a tobacco leaf laid on it.

FIG. 1 illustrates a spread base or table 1, which for instance consists of a perforated top plate of a suction box and comprises a marking field 2 within which the mid rib of a tobacco leaf 3 shall lie. Said tobacco leaf must lie as smooth as practically possible on the table 1, but the aids serving this purpose have nothing to do with the present invention and are so not shown.

The table 1 comprises knives 4 only symbolized by lines for the knife edges and which, when driven over by one or more rollers, not shown, divide the leaf into a number of strip pieces 5*a*, 5*b*, 5*c* and waste material at the mid rib and at the lateral edges. The knives 4 are inclined in relation to the mid rib with the above explained purpose and the inclined position as chosen may be determined by the sizes, or formats, of the wrappers to be produced, and by the size of the tobacco leaf 3.

Figure 2:
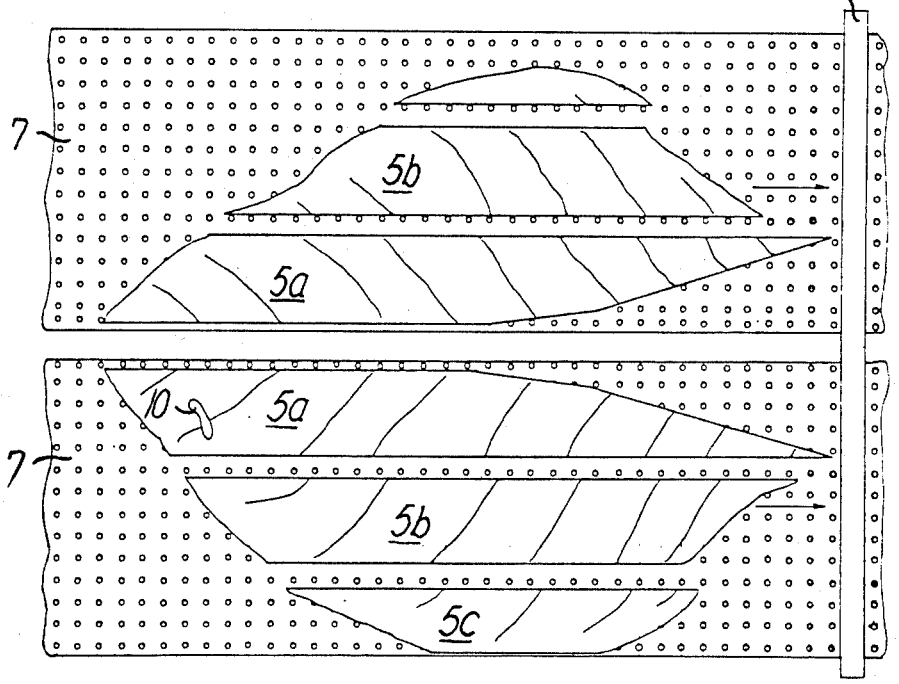
FIG. 2 is a similar view of the strip pieces cut out from the tobacco leaf and after having been transferred to the first section of a conveyor.
Figure 3:
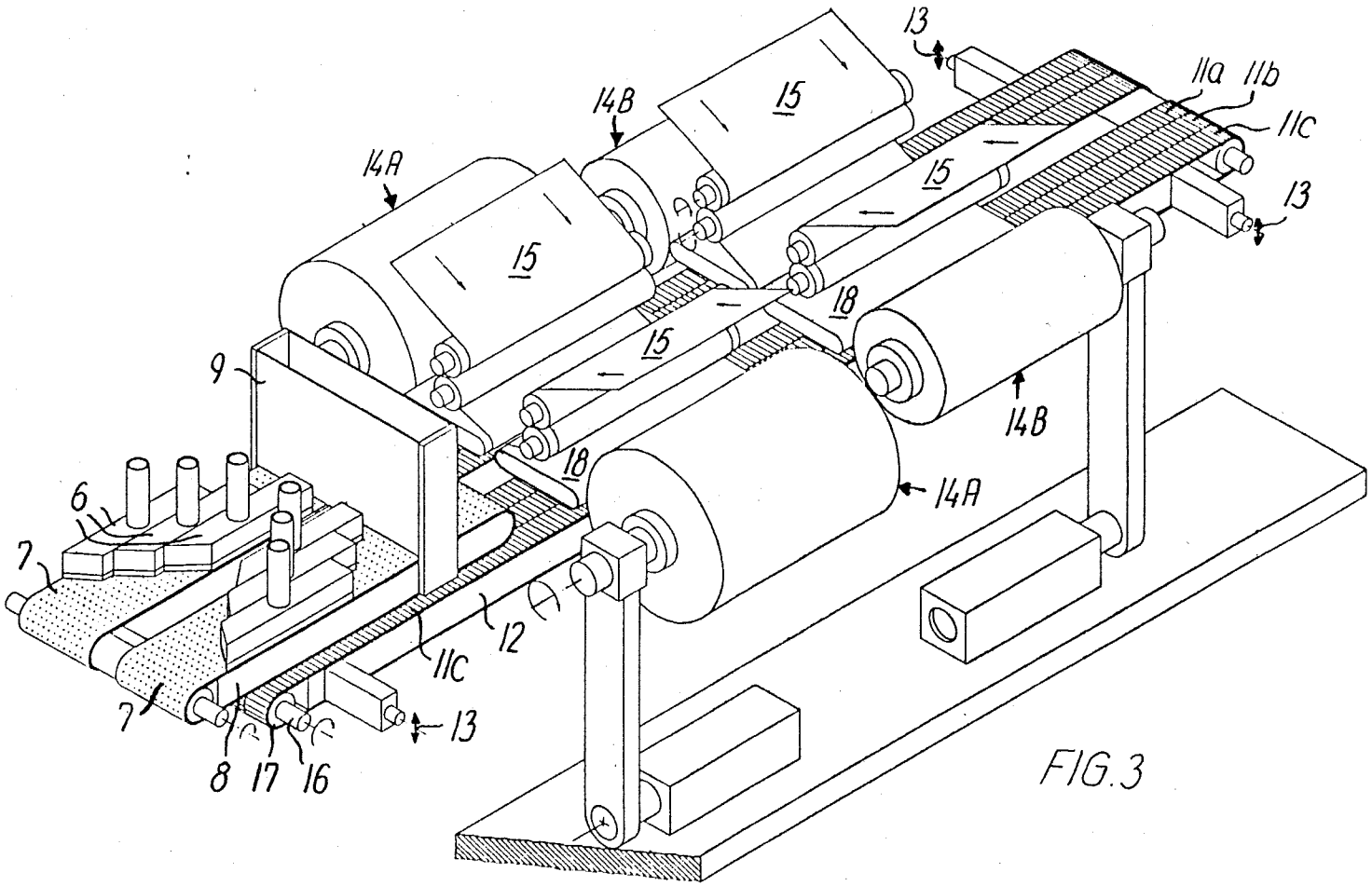
FIG. 3 is a perspective view of the most important parts of an apparatus according to the invention with three conveyor belts and two bobbin units for either half of a tobacco leaf.

The strip pieces 5 as cut are taken off the table 1 by means of pivotal and mutually tiltable suction heads 6, FIG. 3, a set of such suction heads being provided for either half of the tobacco leaf to deliver the strip pieces to a first conveyor section consisting of two parallel, perforated, endless belts 7, FIG. 2 and 3, running around a suction box 8. The upper run of the belts 7 passes a scanner 9 for the strip pieces positioned parallel to the belts, to ascertain nondefective areas sufficiently large for primarily the largest size A, secondarily the second largest size B etc. to be produced. As a matter of simplification, the embodiment as shown only makes provision for two sizes A and B, see FIG. 4, and at best the largest size A should be cut out from all four strip pieces 5*a* and 5*b*. The scanner 9 ascertains, however, that the strip piece 5*a* in the lower (left) half of the leaf includes a hole 10 reducing the usable area to size B, and that its size is actually the largest one to be cut out from the strip piece 5*b* in the upper (right) half of the tobacco leaf 3.

The scanning picture is transferred to a computer, not shown, and the belts 7 are arrested after the pieces have passed the scanner 9 and have been positioned above the left end of second conveyor section which for either half of the leaf comprises three parallel air-permeable belts 11*a*, 11*b* and 11*c* for the strip pieces 5*a*, 5*b* and 5*c*, respectively. Said belts 11 run around a suction box 12 and they can together with said box be raised and lowered a little as indicated by the double arrows 13 in FIG. 3. When raised the strip pieces 5 are transferred from the lower run of the belts 7 to the upper run of the belts 11 extending past two bobbin units 14A and 14B with webs 15 that are being wound while moving in the directions of the arrows. Each of the bobbin units is arranged to receive a respective size A and B, which in this case means that the belt 11*a* for the lower half of the leaf shall carry the strip piece 5*a* past the bobbin unit 14A and forward to the unit 14B, while the feeding step of the belt 11*b* must be adapted so that the strip piece 5*b* stops opposite the bobbin unit 14A. At the same time the belt 11*c* may carry the piece 5*c*, which in this case is waste material, past both of the bobbin units.

Figure 4:
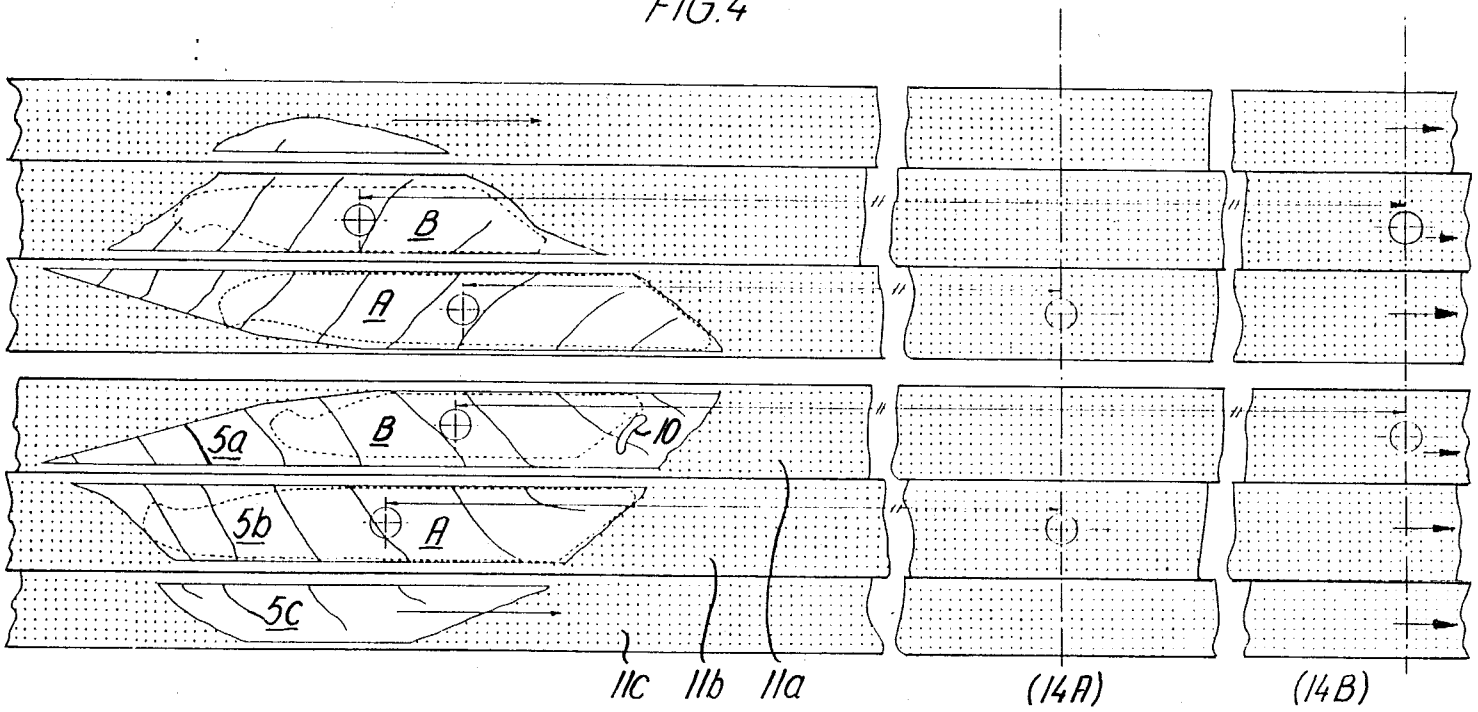
FIG. 4 is a diagrammatic plan view of a section of the belts with strip pieces just laid on them.

As it appears from FIG. 4 it is, however, not sufficient to operate the belts 11 with fixed step lengths, because the usable areas of the different strip pieces 5 that are predestined for the same bobbin 14 may be offset in relation to each other in the advance direction, as indicated by the circles to the left in the figure, whereas they should be transversely aligned in the take-off position, see the right side of the figure. The precise length of step for each of the belts can be derived from the scanning picture created by the scanner 9, and on this basis the driving mechanism for each of the belts can be programmed for the correct length of step as far as each operation is concerned. FIG. 3 implies that the belts 11 are driven by a common shaft 16 but over bushings 17 which can be clutched in and declutched according to requirement. Usable mechanisms for this purpose are on the market and need not be explained in detail.

When the strip pieces 5 have reached the desired position, the suction box 12 with the belts 11 is lifted again to deliver said pieces to the bobbin units 14 and to receive a new set of strip pieces from the belts 7.

Figure 5:
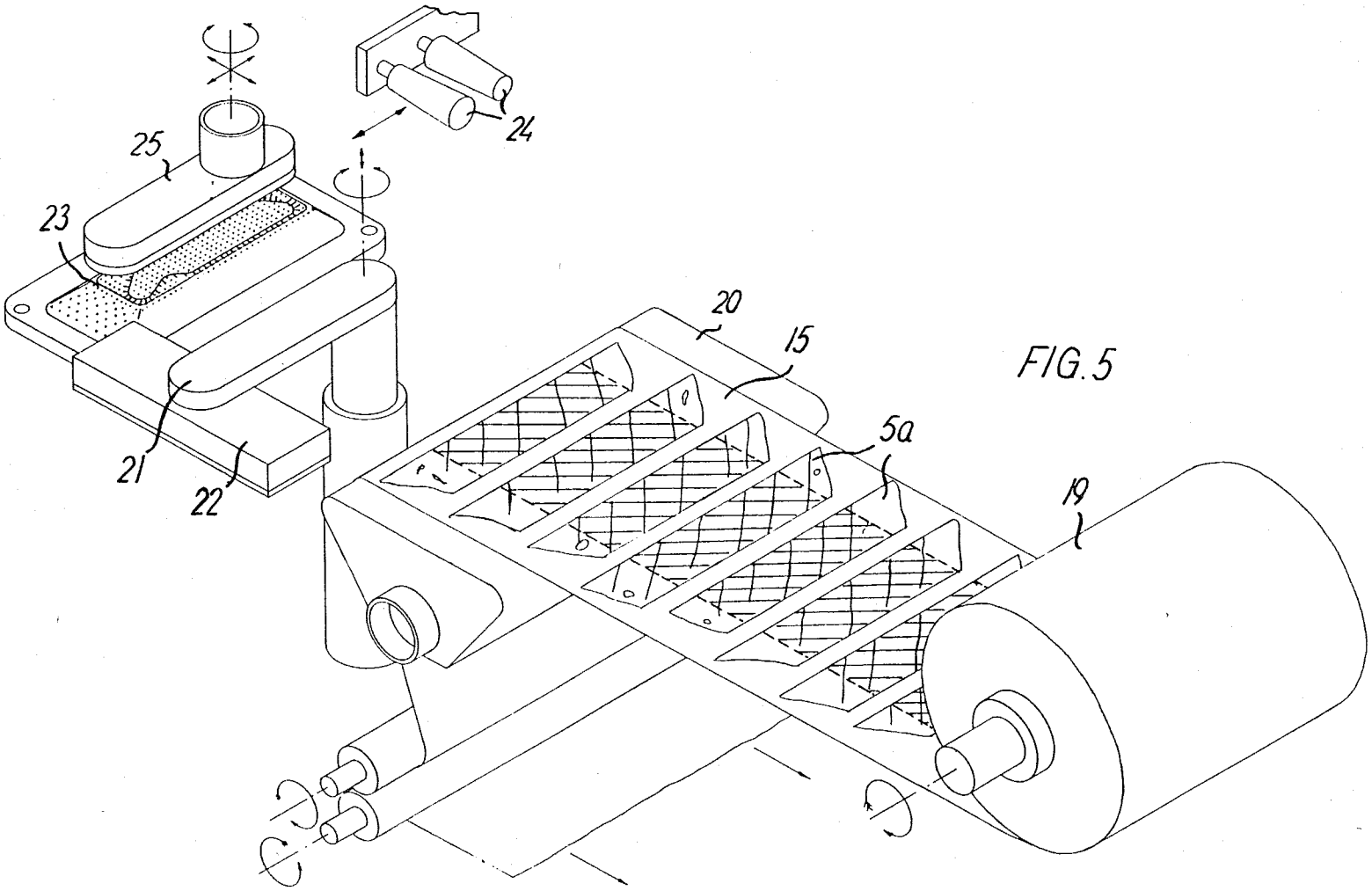
FIG. 5 is a diagrammatic plan view of a bobbin unwinding device and a punching tool associated therewith for cutting out wrappers ready for use.

The transfer from the belts 11 to the bobbin webs is also effected by suction, said webs 15 being during the winding step pulled forwards along the bottom side of suction boxes 18 under sufficiently high vacuum to retain the pieces against the webs until they are so to say, gripped between two turns in the bobbin. The winding of the bobbin webs 15 can be controlled so that no wider spaces than necessary occur between the succeeding strip pieces 5, see FIG. 5.

This figure shows unwinding of a bobbin 19 with strip pieces 5*a*. The usable areas of said pieces are set off by hatching (transversely to the lateral ribs of the tobacco leaf) and are seen to be aligned as emphasized above. The web 15 is drawn stepwise across a suction box 20, the various strip pieces being thus brought into a take-off position in which the usable area is correctly localized. This firm localization is maintained during and after transfer of the strip pieces by means of a pivotal arm 21 with a suction head 22 to a cutting or punching device 23 comprising one or more driving-over rollers 24 and a further suction head 25 to grasp the wrapper ready for use.

It will be understood that the number of conveyor belts 11 for either half of the tobacco leaf must correspond at least to the number of strip pieces 5 to be cut out of the half leaf concerned and that the number of bobbin units must correspond at least to the number of sizes, but said last number is independent of the number of belts. It will be understood as well that an existing apparatus is very flexible in the sense that possibly superfluous belts 11 may simply be taken out of operation and that supplementary bobbin units 14 may be supplied according to requirement, when only the belts 11 are sufficiently long.

We claim:

1. A dual step method of cutting out wrappers or binders in at least two sizes from tobacco leaves which in a first step are cut into stripshaped pieces that are collected in bobbins and from which the final blanks ready for use are cut in a second step, comprising:

scanning each piece of strip by means of a scanner to ascertain usable final blank areas of successively decreasing size to be cut out in the second cutting step, and distributing the strip pieces cut out of either half of the tobacco leaf (right and left sides), according to the size of their usable area, among a number of bobbins corresponding to the number of sizes, said bobbins comprising a web on which the strip pieces are oriented parallel to the axis of the bobbin and with the usable areas in alignment with each other longitudinally of the web so as to be prepared for the second cutting strip.

2. A method as claimed in claim 1, including cutting out the strip pieces in either half of the tobacco leaf in a longitudinal direction to form an angle with the axial direction of the tobacco leaf, and subsequently positioning said strips parallel to said axial direction prior to the passage past the scanner.

3. An apparatus for cutting out wrappers or binders in two or more sizes from tobacco leaves, comprising:

a strip cutting device, a bobbin winding device including a plurality of bobbin units, a conveyor extending between said devices and comprising at least two parallel independently and intermittently movable belts to pick up and to retain by suction a respective one of a plurality of strip pieces cut out side-by-side from the same half of a tobacco leaf, a scanner disposed above the conveyor to ascertain usable areas in the strip pieces, said bobbin units associated with the conveyor bands being positioned one behind the other along the conveyor belts with their bobbin axes parallel thereto, and each bobbin unit comprising a mechanism activated by signals received from said scanner and operative to take off only those strip pieces that are predestined for the bobbin concerned.

4. An apparatus as claimed in claim 3, wherein the take-off mechanism of each bobbin unit comprises a suction box mounted above and opening towards the conveyor belts, the bottom of said suction box being covered by the bobbin web during its movement towards the bobbin, and said conveyor belts when otherwise stationary being movable towards and away from the bobbin web on the suction box.

5. An apparatus as claimed in claim 3 or claim 4, wherein the length of each advance movement of the belt is controlled in dependence on the signals received from the scanner so that the strip pieces predestined for the same bobbin unit are placed with their usable areas in a predetermined take-off position vis-a-vis the bobbin unit.

* * * * *